United States Patent [19]

Mattesky

[11] Patent Number: 4,464,853

[45] Date of Patent: Aug. 14, 1984

[54] VENTILATED IRONING BOARD

[75] Inventor: Henry Mattesky, Cedar Grove, N.J.

[73] Assignee: Magla Products, Inc., Irvington, N.J.

[21] Appl. No.: 331,594

[22] Filed: Dec. 17, 1981

[51] Int. Cl.[3] ..... D06F 81/00

[52] U.S. Cl. ..... 38/138; 38/16

[58] Field of Search ..... 38/14, 15, 16, 138, 38/137, 139, 1 A; 411/478

[56] References Cited

U.S. PATENT DOCUMENTS

| | | | |
|---|---|---|---|
| 107,469 | 9/1870 | Fischer | 38/16 |
| 827,949 | 8/1906 | Wilkins | 38/138 |
| 1,339,831 | 5/1920 | Locke | 38/138 X |
| 1,575,494 | 3/1926 | Lavendier | 38/137 |
| 2,170,462 | 8/1939 | Putnam | 411/478 X |
| 2,273,851 | 2/1942 | Fay et al. | 38/137 |
| 2,308,807 | 1/1943 | Fay et al. | 38/137 |
| 2,386,045 | 10/1945 | Fay et al. | 38/137 |

FOREIGN PATENT DOCUMENTS

| | | | |
|---|---|---|---|
| 291139 | 5/1928 | United Kingdom | 38/16 |

*Primary Examiner*—Werner H. Schroeder
*Assistant Examiner*—Andrew M. Falik
*Attorney, Agent, or Firm*—Omri M. Behr

[57] ABSTRACT

An ironing board which is constructed from at least two planar members each having at least one planar surface, the planar members being arranged so that the edges thereof abut with the planar surfaces thereof falling in a common plane, there being sufficient space between the edges of the planar members to permit the passage of steam therebetween, the planar members being fastened together in a suitable manner. A plurality of legs are fixedly secured to the planar members to support the planar members above a supporting surface.

3 Claims, 4 Drawing Figures

VENTILATED IRONING BOARD

BACKGROUND OF THE INVENTION

1. Field of the Invention

The present invention relates to ironing boards, and more particularly to a compact ironing board construction which permits the venting of steam therethrough so that a wide range of materials can be used in fabricating the ironing board.

2. Description of the Prior Art

At one time, it was common for ironing boards to be constructed of solid pieces of wood. These pieces of wood were desirable because they could easily be fabricated into the correct shape and were generally heavy enough to give the ironing boards the solidness and weight desired for stability. Unfortunately, wood has a significant disadvantage in that steam from an iron can cause deterioration of the wood in the form of rotting and warping.

More modern ironing boards have been constructed from formed sheet metal which is relatively expensive to manufacture and which must be perforated with a plurality of holes to permit the passage of steam therethrough to preclude deterioration of the metal. Unfortunately, aside from high manufacturing cost, such a construction lacks the desired weight and therefore stability to present a satisfactory surface for ironing.

The present invention overcomes the problems associated with the prior art by providing an ironing board that can be configured in a compact shape and which is constructed of inexpensive materials which are arranged to permit the passage of steam therethrough. Additionally, an ironing board constructed in accordance with the principles of the present invention has sufficient weight to provide a solid ironing surface which is inherently stable.

SUMMARY OF THE INVENTION

Therefore, a primary object of the present invention is to provide an ironing board which can be constructed of inexpensive materials.

A further object of the present invention is to provide an ironing board which does not deteriorate when subjected to steam.

A still further object of the present invention is to provide an ironing board which can be manufactured in a compact configuration.

Still another object of the present invention is to provide an ironing board which has sufficient weight to provide stability.

An additional object of the present invention is to provide an ironing board which is simple in design, relatively inexpensive to manufacture, efficient in operation, and durable.

These objects, as well as further objects and advantages of the present invention, will become readily apparent after reading the ensuing description of the nonlimiting illustrative embodiment and viewing the accompanying drawing.

An ironing board according to the principles of the present invention comprises at least two planar members each having at least one planar surface and a plurality of edges, the planar members being arranged so that selected edges thereof abut each other, the abutting edges being spaced apart a distance sufficient to permit the passage of steam therebetween, the planar surfaces of the planar members being disposed in a common plane; and means for joining the planar members.

BRIEF DESCRIPTION OF THE DRAWINGS

In order that the present invention may be more fully understood, it will now be described, by way of example, with reference to the accompanying drawings in which.

DESCRIPTION OF THE PREFERRED EMBODIMENT

Figure 1:
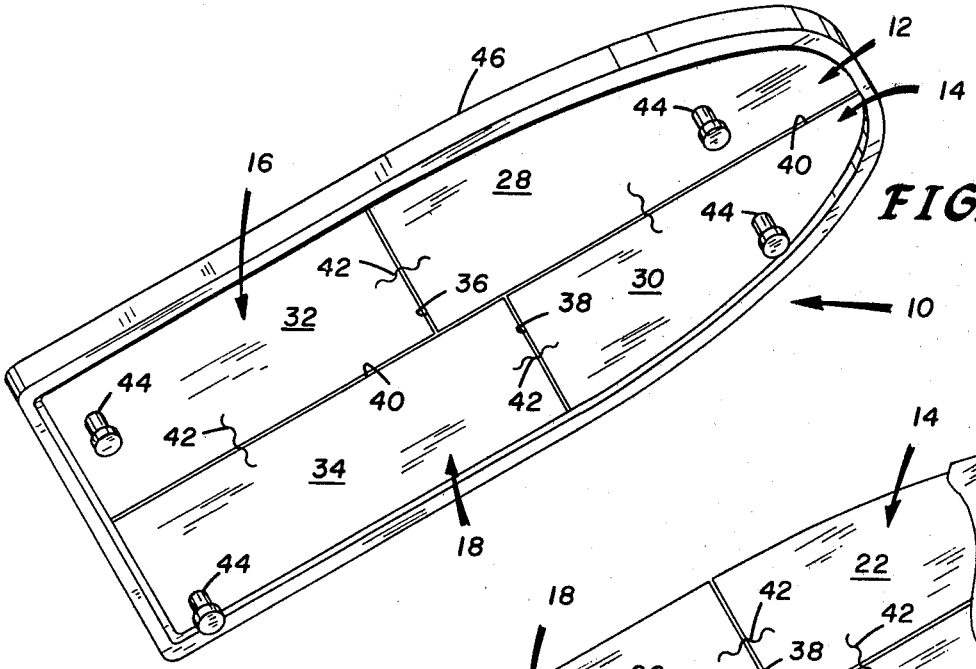
FIG. 1 is a bottom view in perspective of an ironing board constructed in accordance with the principles of the present invention.
Figure 2:
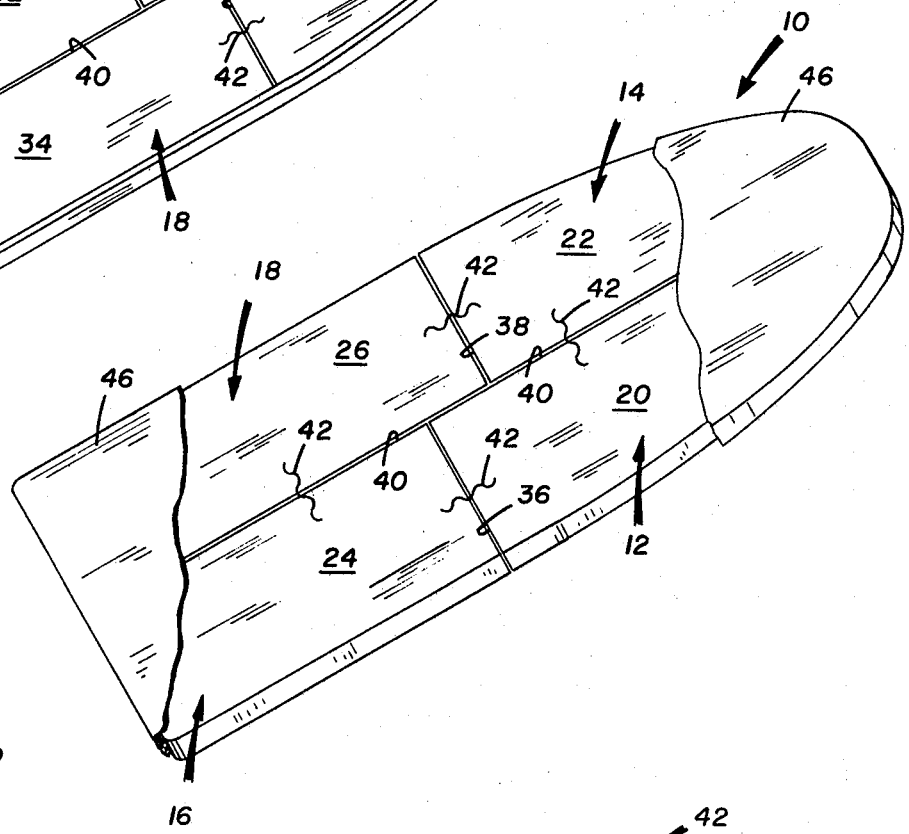
FIG. 2 is a top view in perspective of an ironing board constructed in accordance with the principles of the present invention.

Referring now to the figures, and more particularly to FIGS. 1 and 2 thereof, there is illustrated therein an ironing board 10 which is constructed in accordance with the principles of the present invention. The ironing board 10 comprises a plurality of planar members 12, 14, 16, and 18. The planar members 12, 14, 16 and 18, respectively, each include a top surface 20, 22, 24, and 26 and, respectively, a bottom surface 28, 30, 32, and 34. The planar members 12, 14, 16, and 18 are arranged so that the edges thereof abut each other, but are spaced apart a distance sufficient to permit the passage of steam therethrough. Specifically, planar members 12 and 16 abut each other on the edges thereof with a slight space 36 therebetween, planar members 14 and 18 abut each other with a slight space 38 therebetween, and planar members 12 and 16 abut planar members 14 and 18 with a slight space 40 therebetween. The abutting edges of the members 12 and 16 and 14 and 18 lie in a plane substantially perpendicular to the abutting edges of the members 16 and 18 and 12 and 14.

Planar members 12 through 18 are all uniform in thickness and are arranged such that the top surfaces 20 through 26 thereof all are disposed in a common plane with the bottom surfaces 28 through 34 thereof similarly lying in a second common plane spaced apart from the first common plane. Although surfaces 28 through 34 need not be disposed in a common plane, such is the case if the planar members 12 through 18 are of a common thickness, as illustrated. However, in order to present a proper ironing surface, it is necessary that one surface of each of the planar members 12 through 18, i.e., top surfaces 20 through 26, be disposed in a common plane to provide an ironing surface. As illustrated, the edges of the planar members fall in planes substantially perpendicular to the first and second common planes in which the top surfaces 20 through 26 and the bottom surfaces 28 through 34 are disposed. Certainly, the edges of the planar members 12 through 18 can be at other angles. For instance, the edges can be disposed in planes at angles other than 90° to the top and bottom surfaces of the planar members so long as the edges would be configured to mate to similar edges of adjacent planar members. In the desired construction, the planar members are tapered at one end thereof such as planar members 12 and 14 to form a conventional bullet shaped section.

Figure 3:
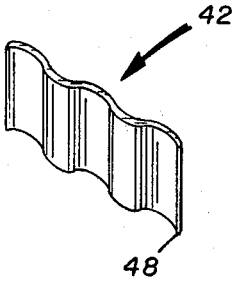
FIG. 3 is a perspective view of one of the corrugated nails used in fixing the planar members of the present invention together.
Figure 4:
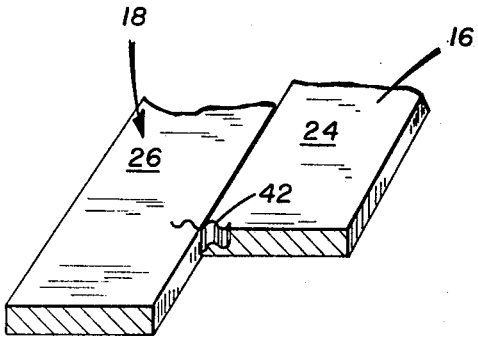
FIG. 4 is a partially broken away fragmentary view in perspective of the manner in which the corrugated nail of FIG. 3 joins together the planar members of the present invention.

The planar members 12 through 18 are joined together by a plurality of corrugated nails 42, as further illustrated in FIGS. 3 and 4. Although the planar members are shown joined together with corrugated nails, other suitable fastening means may be employed. For instance, the planar members could be doweled together, held together with brackets, or could be otherwise clamped together as long as there is a sufficient space between the abutting edges of the planar members to permit the passage of steam therebetween.

As a result of the passage of steam between the planar members, material which otherwise might be deteriorated or warped from steam can be employed. Specifically, the present invention is preferably constructed from an inexpensive particle composite construction material known in the lumber trade as "particle board". Particle board is a sheet construction material which is fabricated from sawdust and wood chips that are bound together by a suitable glue-like binder. This material can be worked very inexpensively, is low in cost in and of itself, and is very dense so that it is rather heavy. In the application of an ironing board, such weight is desirable since it enhances the stability of the ironing board. Specifically, when the ironing board is mounted on a plurality of stubby legs 44, as illustrated in FIG. 1, so that the planar members can be supported above a supporting surface, an extremely stable and effective ironing surface is provided. Since the steam generated by ironing can readily bleed through the spaces between the planar members, deterioration of the particle board material will not be incurred and an ironing board which has the favorable characteristics desired can be fabricated at a very inexpensive cost.

As is customary in ironing boards, a suitable cover 46 is provided to cover the ironing surface provided by the planar surfaces 20 through 26 of the planar members 12 through 18. This cover is of a material well known in the art and may also include a pad, if desired.

Although the ironing board illustrated in FIGS. 1 and 2 is constructed with four planar members, it is to be understood that other configurations including more or less planar members can be employed. For instance, the ironing board 10 could be constructed with two strips of particle board essentially taking the shape of the planar members 12 and 16 together and planar members 14 and 18 together. Alternately, other configurations of planar members can be employed and various numbers of planar members of different sizes can therefore be accommodated. As a result, the present invention can be suitably constructed from a variety of leftover materials therefore further enhancing the ultimate low production cost.

Referring to FIGS. 3 and 4, the corrugated nails used to join the planar members of the present invention together can be observed. The corrugated nails 42 are well known in the art for lateral joining and include a sharpened edge 48 which is driven into the pieces of material to be joined together. A corrugated nail 42 is shown in FIG. 4 joining together sections of planar members 16 and 18. In this instance, the corrugated nail 42 has been driven through the surfaces 24 and 26, respectively, of the planar members 16 and 18. In the desired construction, some of the corrugated nails used to join together the planar members would be driven through one of the common surfaces, in this instance, formed by the surfaces 20, 22, 24, and 26 and some of the corrugated nails would be driven through the other common surface, in this instance, formed by the surfaces 28, 30, 32, and 34. By nailing of the planar members together through both surfaces thereof, increased strength and rigidity is enjoyed. To expedite the fabrication of the present invention, the planar members can be placed in a suitable jig to be held for nailing.

It should be understood that various changes in the details, materials, and arrangements of parts and operational conditions which have been herein described and illustrated, in order to explain the nature of the invention, may be made by those skilled in the art within the principles and scope of the invention.

Having thus set forth the nature of the invention, what is claimed is:

1. An ironing board comprising:

at least two planar members each having at least one planar surface and a plurality of edges, said planar members being arranged so that selected said edges of said planar members abut each other, said abutting edges being spaced apart a distance sufficient to permit the passage of steam therebetween, said planar surfaces of said planar members being disposed in a common plane; and means for joining said planar members, said planar members each comprise a pair of spaced apart planar surfaces having disposed therebetween said edges, said edges falling in a plurality of substantially perpendicular and parallel planes wherein said planes are substantially perpendicular to said spaced apart planar surfaces.

2. An ironing board in accordance with claim 1, wherein said joining means comprises a plurality of corrugated nails, some of said corrugated nails being driven into said planar members through said planar surfaces disposed in said common plane, the balance of said corrugated nails being driven into said planar members through another of said planar surfaces disposed in a second common plane.

3. An ironing board comprising:

at least two planar members each having a pair of spaced apart planar surfaces and each having disposed therebetween a plurality of edges, said edges falling in a plurality of substantially perpendicular and parallel planes wherein said planes are substantially perpendicular to said spaced apart planar surfaces, said planar members being arranged so that selected said edges of said planar members abut other, said abutting edges being spaced apart a distance sufficient to permit the passage of steam therebetween, one of said planar surfaces of each of said planar members being disposed in a common plane, the other of said planar surfaces of each of said planar members being disposed in a second common plane, said planar members being constructed of particle composite construction material;

a plurality of corrugated nails for joining together said planar members, some of said corrugated nails being driven into said planar members through said planar surfaces disposed in said common plane, the balance of said corrugated nails being driven into said planar members through the other of said planar surfaces disposed in said second common plane; and a plurality of legs fixedly secured to selected said planar members, said legs for supporting said planar members above a supporting surface.

* * * * *